United States Patent [19]

Cross

[11] Patent Number: 4,704,775

[45] Date of Patent: Nov. 10, 1987

[54] TURN GATE FOR USE WITH A ROBOTIC WIRE HARNESS ASSEMBLY SYSTEM

[75] Inventor: Dan A. Cross, Seattle, Wash.

[73] Assignee: The Boeing Company, Seattle, Wash.

[21] Appl. No.: 798,999

[22] Filed: Nov. 18, 1985

Related U.S. Application Data

[63] Continuation-in-part of Ser. No. 741,318, Jun. 4, 1985, Pat. No. 4,677,734.

[51] Int. Cl.[4] ..... H01R 43/00

[52] U.S. Cl. ..... 29/33 M; 29/755; 29/825; 248/68.1; 269/131; 269/237; 269/903

[58] Field of Search ..... 269/130, 131, 237, 287, 269/903; 29/33 F, 33 K, 33 M, 742, 745, 747, 755, 759, 760, 825, 854, 857; 248/49, 68.1; 24/336, 535, 543, 569

[56] References Cited

U.S. PATENT DOCUMENTS

| | | | |
|---|---|---|---|
| 508,822 | 11/1893 | Evory | 248/68.1 |
| 3,627,300 | 12/1971 | Caveney et al. | 269/131 |
| 3,883,929 | 5/1975 | Fortsch | 269/131 |
| 4,114,846 | 9/1978 | Petersen | 248/68.1 |
| 4,433,479 | 2/1984 | Suzuki et al. | 29/755 |
| 4,566,502 | 1/1986 | Kellogg | 269/903 |

*Primary Examiner*—Gil Weidenfeld
*Assistant Examiner*—Daniel W. Howell
*Attorney, Agent, or Firm*—O'Connor, Johnson & Kindness Christensen

[57] ABSTRACT

A turn gate is used for receiving and supporting a plurality of wire segments that are successively guided laterally into contact with it by the robotic device during the assembly of the wire harness. The turn gate is positioned at bends in the wire harness and is configured so that each wire segment is positioned on a predetermined location on the inside radius of the curve.

14 Claims, 7 Drawing Figures

TURN GATE FOR USE WITH A ROBOTIC WIRE HARNESS ASSEMBLY SYSTEM

The United States Government has rights in this invention pursuant to Contract No. DAAH01-82-D-0013-0003 awarded by the U.S. Army.

RELATED APPLICATIONS

This application is a continuation-in-part of an application filed June 4, 1985, Ser. No. 741,318, entitled Robotic Wire Harness Assembly System, now U.S. Pat. No. 4,677,734.

FIELD OF THE INVENTION

This invention relates to a turn gate used in conjunction with robotic assembly of a wire harness.

BACKGROUND OF THE INVENTION

A wire harness is a bundle of wires that can be handled as an element and can be easily installed to interconnect components of various electrical and electronic systems. The shape of a wire harness is dictated by the environment for the harness and the particular location of connections for the harness. Accordingly, a wire harness often includes one or more bends, and branches for routing various wire segments of the harness to their corresponding connection points.

A harness often includes 50 or more wires, each uniquely terminated and uniquely positioned. It is important that each wire extend from a predetermined position on one connector to the corresponding position on a second connector. Bends must be formed into each wire during lay up or the final product will not be satisfactory.

When done manually, the wire is cut to length after being inserted into the originating connectors and being laid up in the necessary path. Each wire must be identified so that the technician can place the correct wire in the correct contact of the connector. Even for simple harnesses, the task is Herculean, making the manual assembly of wire harnesses extremely labor intensive.

Robotics in manufacturing has recently lead to research and development of robotic systems for assembling wire harnesses. To achieve robotized assembly, special tools for handling the wire had to be developed, since the lengths of wire were difficult to handle without some precise control. While robots can move in predefined paths, they are not intelligent and cannot make even rather minor course corrections. Therefore, the tools necessarily had to be designed to overcome the variations that would undoubtedly occur so that the preciseness of the robot motion could still be utilized.

SUMMARY OF THE INVENTION

This invention is directed to a turn gate that is positionable on a work surface over which a robotic device assembles a wire harness. The turn gate receives and supports a plurality of wire segments that are successively guided laterally into it by the robotic device to create bends in the wire harness. The turn gate has a gap or mouth which receives the wire. A slippery cord tensioned across the gap contacts the wire and guides the wire into the gate along the inside radius of the curve to a position that can be accurately predetermined, thereby allowing the wire to be precut and preconfigured. A spring maintains a relatively constant tension on the cord, irrespective of the number of wires added to the harness bundle held within the gate. A pivotal top bracket allows easy release of the complete harness from the guide.

The turn gate maintains the true turn radius for the bend in the harness and keeps the wires from tangling.

BREIF DESCRIPTION OF THE DRAWINGS

DETAILED DESCRIPTION

A. System Overview

Figure 1:
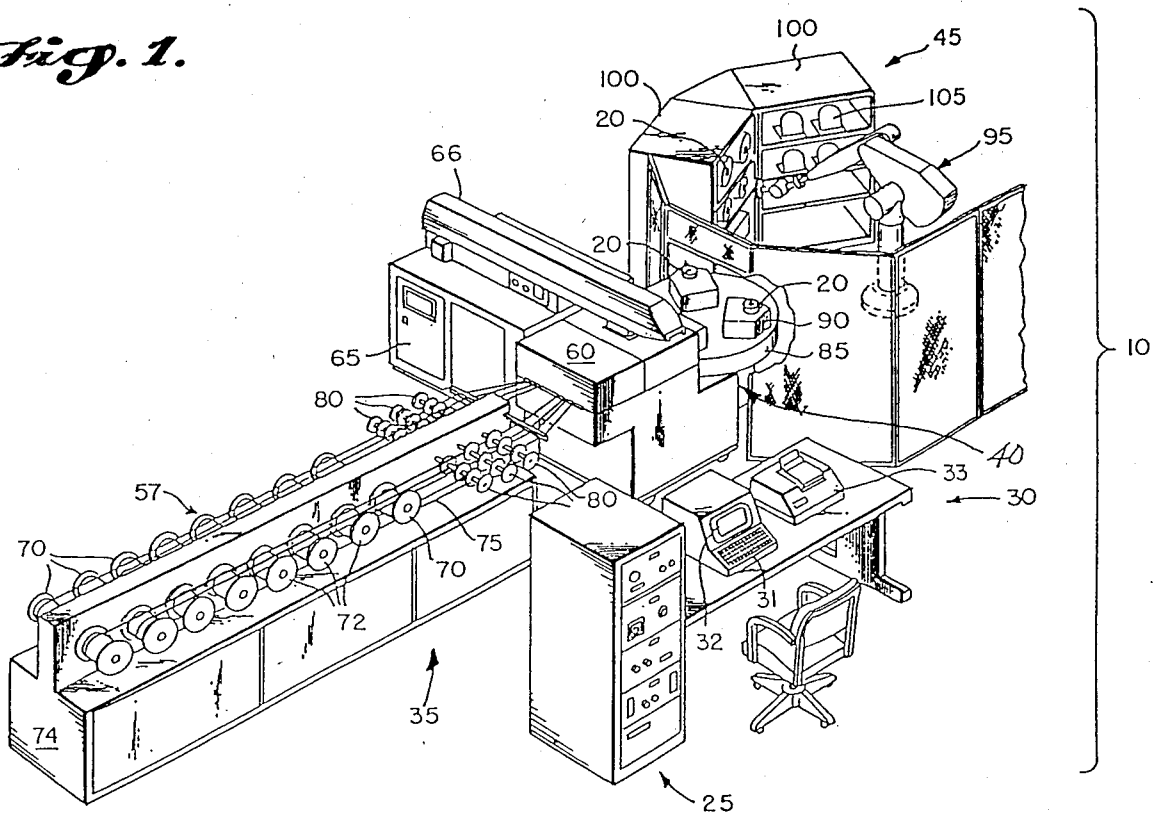
FIGS. 1 and 2 illustrate a wire harness assembly system using the turn gate of this invention.
Figure 2:
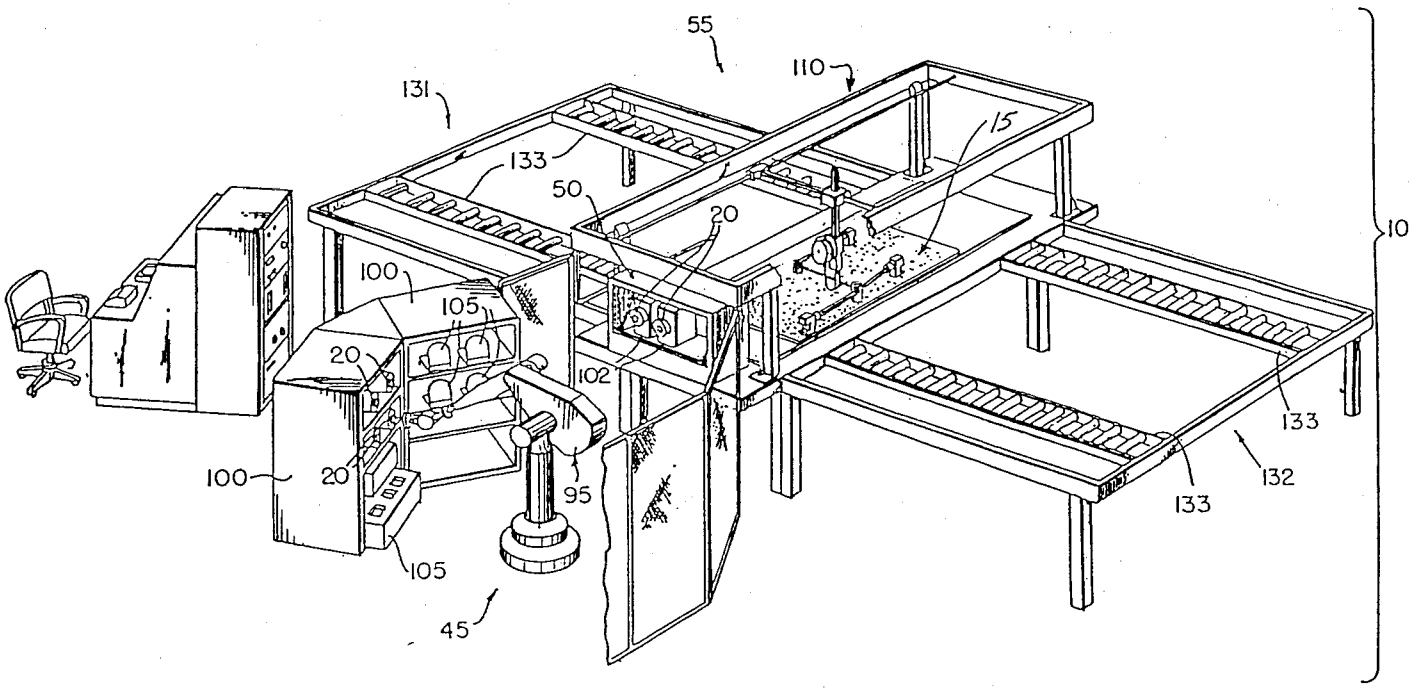

As shown in FIGS. 1 and 2, the system 10 is an integrated combination of hardware and software capable of performing the task of producing an electrical wire harness 15. Data necessary for controlling each subsystem of the system 10 is generated in an off-line CAD computer and is transmitted from the computer to a control system 30, which includes: a master system computer 25; data input devices (such as keyboard 31); and data output devices (such as a CRT 32 and printer 33). The system computer 25 supplies control signals to a wire preparation subsystem 35, a wire reeling subsystem 40, a wire termination subsystem 45, a wire queuing subsystem 50, and a wire layup subsystem 55, as described in U.S. Pat. No. 4,520,966 and U.S. patent application, Ser. No. 741,318.

The master system computer 25, preferably an INTEL 86/380 segmented into six internal computers, converts input engineering data from an associated VAX data generator computer and keyboard 31 into processing commands required to operate the assembly system components in the several subsystems for assembly of a wire harness. The control commands are distributed to appropriate subsystem controllers (which command and monitor each step of the harness assembly process). The input and output devices included with the control system 30 allow the operator to communicate with the subsystems to directly control the sequence of activity in the system 10, to input additional commands manually, or to override the data generator input or master system computer.

The wire preparation subsystem 35 uses a commercial WESTLAND Laser Cable Marking System, to mark and cut wire segments. The system includes a wire de-reeling station 57, a marker/cutter unit 60, and a control computer (not shown). Generally a slave to the master system computer, the WESTLAND control computer allows direct control of the subsystem, if desired. The wire de-reeling station 57 holds a plurality of wires of different dimensions on several, replaceable wire reels or spools 70, and allows selection of the desired wire by the marker/cutter unit 60. The spools 70 are journalled onto shafts 72 extending through the base 74 of the de-reeling station 57. Wires 75 are tensioned by a series of idler and tensioning pulleys 80 on the base 74 and are pulled to the marker/cutter 60 by a positive feed drive roller (not shown) in the unit 60.

The marker/cutter unit 60 also includes an alignment system for drawing a selected wire onto the drive rollers, a laser 66 of suitable power, and associated control and targeting equipment (not shown) to print identification markings on the wire. A guillotine blade actuator (not shown) cuts the continuous wire into wire segments. Each wire has a unique length. Specifically, for a plurality of wire segments in a wire harness extending between two end connectors, the length of each wire segment in the harness depends upon its location within the harness. For any particular wire harness assembled in accordance with this invention, input data describes the precise position that each wire segment will assume in the harness and the precise lengths of that wire. The wire preparation subsystem 35 selects, marks, measures, and cuts the wire 75 while feeding cut segments into the wire reeling subsystem 40.

In the wire reeling subsystem 40 each wire segment is wound into an individual wire canister 20 that can be easily handled by a robot during the remaining steps of the harness assembly.

The wire termination subsystem 45 includes a MERLIN robot 95, which swivels to pick up a loaded canister 20 from the wire reeling subsystem 40 and presents either the leading end 76 or the trailing end 78 of the wire segment 77 to one or more of several termination devices 105, located in a rack 100, which terminate the ends of the wires. After both wire ends are properly terminated, the robot 95 places the canister 20 in a receiving bay 102 of the wire queuing subsystem 50, releases the canister, picks up an empty canister from an adjacent bay 102, and returns to the wire reeling subsystem.

Figure 3:
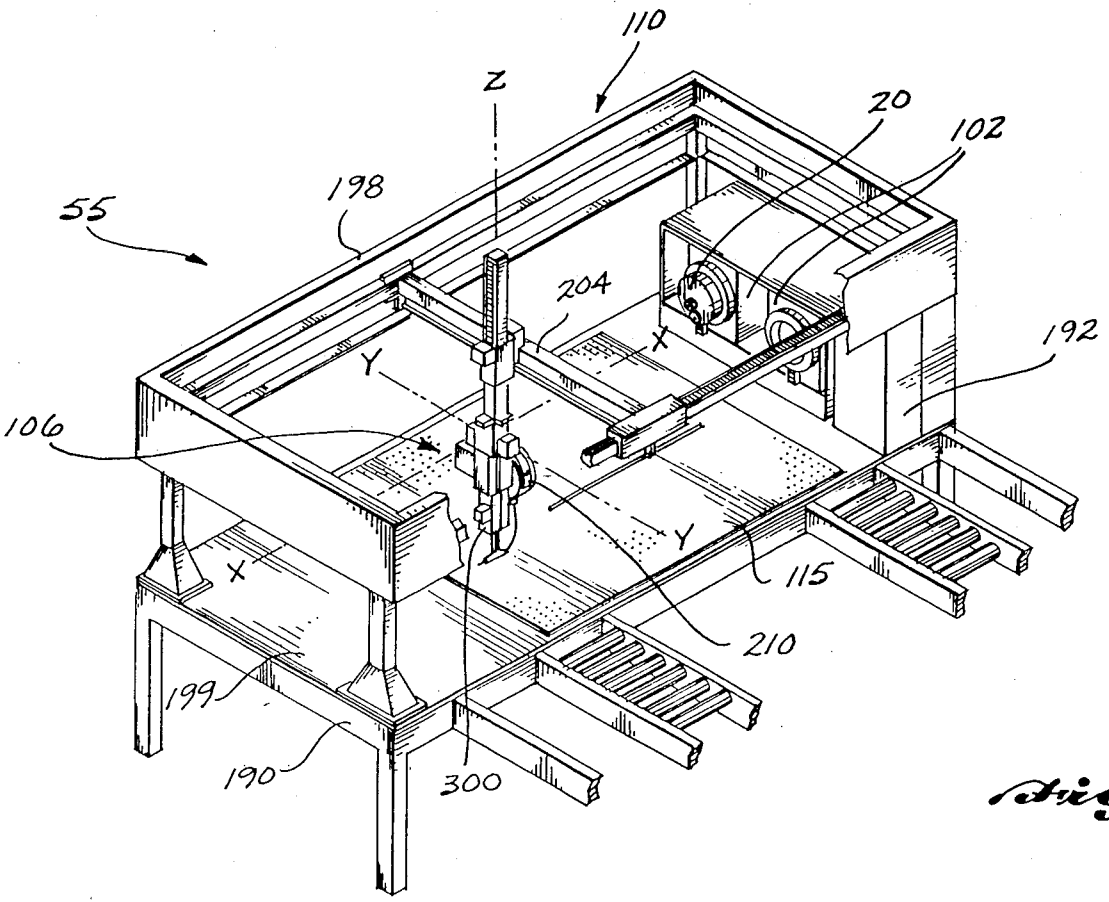
FIG. 3 is an isometric view of the wire queuing and wire layup subsystems of the harness assembly system.

The wire layup subsystem 55 (depicted in FIGS. 2 and 3) includes an IBM Model 7565 robot 110; a clamp 210, which carries a canister 20 during wire routing operations; and, a wire routing tool 300, which is connected with the layup robot 110.

The layup robot 110 includes a rectangular table 190, having a rectangular frame 198 supported above and parallel to the table's surface. Mounted between the oppositely disposed major sidewalls of the frame 198 is a beam 204 that can be driven along the length of the sidewalls in the x direction of a Cartesian coordinate system. Depending downwardly from the beam 204 is a manipulator arm 106 that can be driven along the length of the beam in the y direction. The manipulator arm 106 can be rotated about its longitudinal axis (z axis in FIG. 3) and can be moved upwardly and downwardly.

Figure 4:
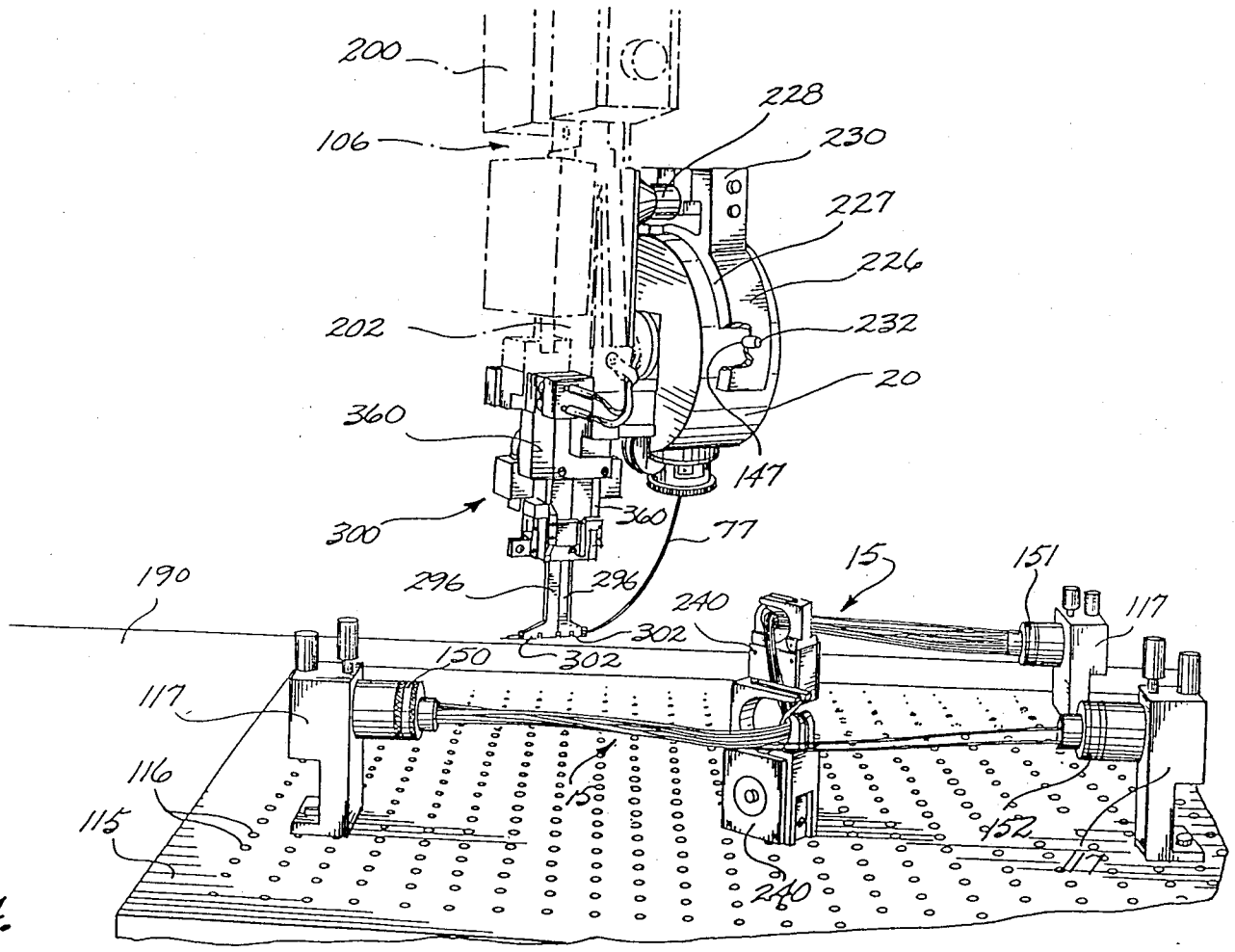
FIG. 4 is an isometric view of the manipulator arm of the layup robot positioned over a form board.

As is best shown in FIG. 4, a wire layup tool 300 is attached to a jaw unit 202 depending from the main member 200 of the manipulator arm 106.

The tool 300 includes two substantially identical legs 296 that extend downwardly from a housing 360, which is mounted to the jaw unit 202. Each leg 296 is pivotally mounted within the housing 360 and the legs 296 can be independently swung about pivot points to move the lower end of that leg toward or away from the other leg. Integrally formed in the lower end of each leg 296 is an outwardly extending foot 302 that includes a downwardly facing groove 344 that serves as a wire-guide. When the legs 296 are swung together (FIG. 4), the feed 302 and grooves are aligned. Each foot 302 can independently grasp (clamp) a wire that passes through the groove of that foot or can allow the wire to pass freely within the groove.

To construct a wire harness 15 with wire layup subsystem 55, a rectangular form board 115 that includes a rectangular array of spaced holes 116 is placed on the top work surface of table 190 for access by the tool 300. Connectors 150, 151 and 152 for the wire harness are mounted within connector blocks 117 of the present invention that are positioned on the form board 115. Turn gates 240, which allow bends to be formed in the wire harness even with precut wires, are also installed in the holes 116 of form board 115. The connector blocks 117 precisely position each connector in the harness. The robot 110 picks up a canister 20 that contains a wire segment 77 from one of the receiving bays 102, in the grooves formed in the feet 302 of tool 300, inserts one end of the wire segment 77 into a receptacle of a connector, moves the tool 300 along a predetermined path to dispense the wire segment 77 in the harness, and installs the second end of the wire segment into a second connector, before returning the empty canister 20 to the receiving bay 102. The process is repeated until the wire harness 15 is complete.

B. Turn Gate

Bends can be formed in a wire harness using turn gates 240 that capture and retain each wire segment 77. The turn gate formed in accordance with this invention controls the positioning of each wire segment as it is routed through the bend in the harness. The turn gate guides each wire into the inner region of the bend of the wire harness. Knowing that the wire will be located on the inner radius of each bend through which it is routed, the length of the wire segment can be predetermined with precision.

To these ends, a turn gate is positionable on a form board 115 where bends are to be formed in the wire harness and functions to collect and hold successive wire segments 77 that are directed laterally into it by the layup robot 110. A wire segment reaches the inside of the turn gate via an entry gap or mouth. The turn gate also includes a slippery tension cord that spans the entry gap and yields to each newly introduced wire segment to guide that segment along the inner radius of the bend go position the wire in a location that is predeterminable so that the wire can be precut and preconfigured.

The turn gate 240 includes a base 564 having a bore 574 that extends between its side surfaces 566. A channel 572 extends along the bottom and part-way up the front surface of the base. An L-shaped bracket 570 is secured at a desired position on the form board 115 with a headed fastener 578 in the center of the horizontal leg of the bracket 570. The base of the turn gate is mounted on the bracket 570 with a screw 573 through the vertical leg of the bracket.

A plate 578 is fastened to each side surface 566 of base 564, extending over the lower portion of the base to enclose the bore 574. One plate carries a reel 580 that fits within the bore. The reel has a TEFLON-coated cord 584 wrapped around its periphery and an internal spring (not shown) that tensions the cord. A model ML-3949 "negator spring" from Ametex is preferred because it provides a relatively constant tension irrespective of the amount of cord withdrawn from the reel.

The top surface of the base is contoured to form a concave region of constant radius. Extending upwardly from one edge of the concave region is a finger 590 having a radius of curvature that matches the curvature of the top surface. A smoothly rounded tip 596 is formed at the end of finger 590.

Figure 5:
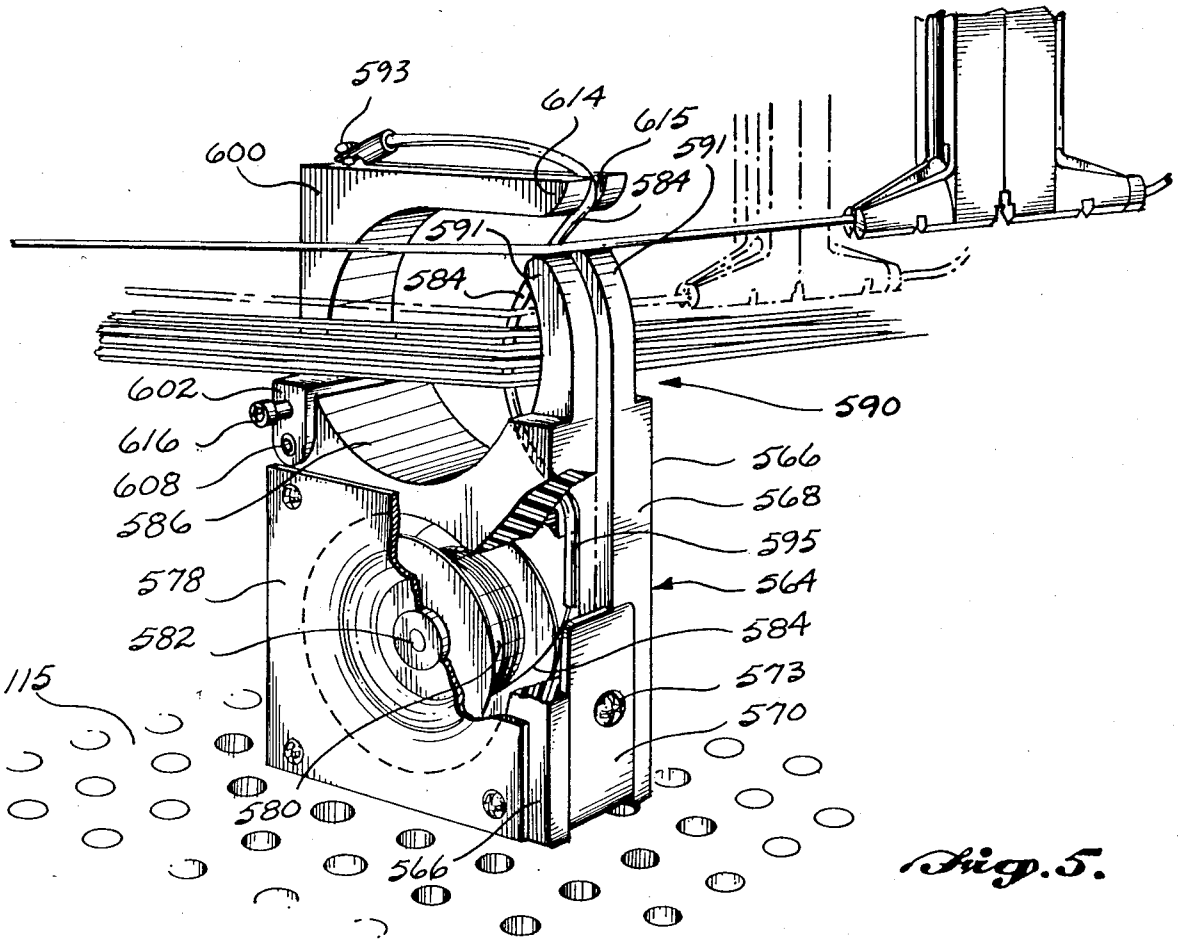
FIG. 5 is an isometric view of a preferred turn gate.

A bracket 600 extends upwardly from the other edge of the concave region, and is attached to the base by a hinge 602. When the bracket is closed (FIG. 5), one end 614 of the bracket 600 is positioned immediately above the tip 596 of the finger 594. The inner surface of the bracket 600 is curved, having a radius of curvature substantially identical to that of the top surface 568 and finger 592 defining a bore to contain the harness wires.

The cord 578 passes from the reel through a longitudinal slot of passage 595 formed in the base and finger to a notch 615 inthe tip 614 and anchors with a screw 593 or other suitable means to the bracket 600. The cord has a low coefficient of friction, minimizing hang up of the wire segments when they contact the cord. The finger 590 is also made of material having a low coefficient of friction, such as DELRIN, thereby minimizing abrasion between the finger and passing wire.

The turn gate is positioned on the form board 115 with its vertical centerline located inside the inner radius of the bend and its horizontal centerline bisecting the internal angle of the bend, and receives a wire segment from a robot that moves near the tip 596 of the finger past the mouth. The gap faces the bend and the gate is entirely within the curve of each wire as it is presented to the gate.

Once the tool is past the turn gate, the tool is turned so that it is aligned with the portion of the harness that is upstream of the turn gate. Simultaneously, the tool 300 is moved downwardly until it is at an elevation slightly lower than the tip 596 (FIG. 7) to slide the wire segment along the cord and to position it along the inside radius of the wires previously placed in the turn gate. As additional wire segments are added, the cord directs each wire into a similar position without disturbing the position assumed by previously installed wire segments.

Figure 6:
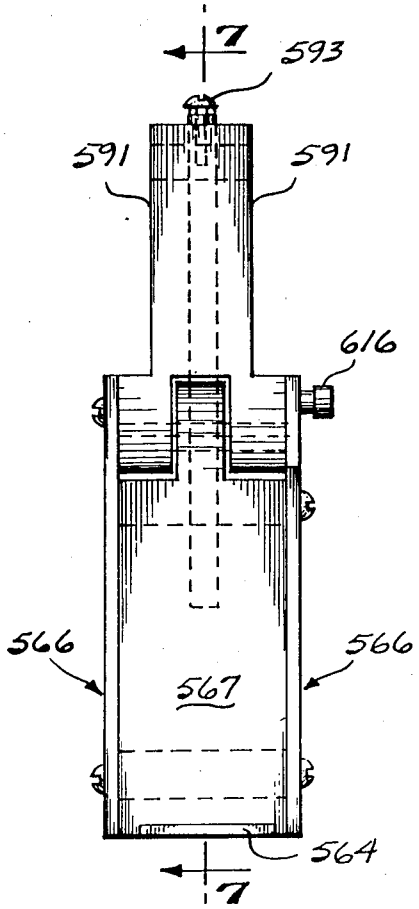
FIG. 6 is a back elevation view of the turn gate of FIG. 5.

A removable lock pin 616, which extends between the hinge elements of hinge 602, keeps the bracket 600 in its upright position (as shown in FIG. 6) during assembly of the wire harness. After the wire harness is completely constructed, the lock pin 616 is backed off so that the bracket is free to pivot, thereby permitting the wire harness to be removed from the turn gate.

The finger 594 may include a central ridge to reduce the surface area of contact between the wire and the turn gate and, thereby, to reduce the possibility of the wire hanging up on the gate.

The reel, turn gate body, and bracket end are configured so that the cord is biased toward the mouth so that each wire that enters the gate will contact the cord and be guided the cord to its proper place in the bundle.

Generally, the robot positions the wire on the upwardly-sloped section 802 (FIG. 7) of the finger 594 and pulls the wire up the slope as it forms the bend in the harness. In this way, the wire must engage the cord and cannot be misoriented.

The gates ensure that the precut wire is long enough to insert into a terminal connector. Previous to the development of this gate, precut wires could not be used in assembling wire harnesses.

While a preferred embodiment has been shown and described, those skilled in the art will recognize alterations, modifications and variations that might be made to these embodiments without departing from the inventive concept. Therefore, the claims should be interpreted liberally to protect the described embodiments and their reasonable equivalents. The description and drawings are meant to illustrate the invention and are meant to limit the invention only insofar as limitations are necessary in view of the pertinent prior art.

The embodiments of the invention in which an exclusive property or privilege is claimed are defined as follows:

1. A turn gate for receiving and supporting a plurality of wire segments at a bend in a wire harness assembled by a robot, the bend having an inner radius and an outer radius, the turn gate comprising:

(a) a base inluding a finger;

(b) a bracket on the base, the bracket having an outer end located adjacent to the outer end of the finger, defining an entry gap with the finger through which the wire segments are received;

(c) a guide member, interconnected between the bracket and the base and extending across the entry gap, for directing each wire segment received through the entry gap to the inner radius of the bend, wherein the guide member is a cord, one end of the cord being fixed to the bracket; and (d) a reel housed within the base, the other end of the cord being coiled around the reel; the reel including means for maintaining tension in an extended portion of the cord.

2. The turn gate of claim 1, wherein the tensioning means maintains a relatively constant tension in the cord.

3. The turn gate of claim 2, wherein the tensioning means includes a spring associated with the reel.

4. The turn gate of claim 3, wherein the spring is a negator spring that maintains a relatively constant tension on the cord.

5. The turn gate of claim 1 wherein the bracket is hingedly attached to the base.

6. The turn gate of claim 5 further including a detachable lock pin connectable between the base and the bracket for preventing hinged movement of the bracket.

7. The turn gate of claim 1 wherein the finger and the cord have a low coefficient of friction.

8. The turn gate of claim 1 wherein the finger includes a longitudinal slot for receiving and guiding the cord.

9. A turn gate for receiving and supporting a plurality of wire segments at a bend in a wire harness assembled by a robot, the bend having an inner radius and an outer radius, the turn gate comprising:

(a) a base including a finger;

(b) a bracket hingedly attached the base, the bracket having an outer end located adjacent to the outer end of the finger, defining an entry gap with the finger through which the wire segments are received;

(c) a guide member, interconnected between the bracket and the base and extending across the entry gap, for directing each wire segment received through the entry gap to the inner radius of the bend; and (d) a detachable lock pin connectable between the base and the bracket for preventing hinged movement of the bracket.

10. The turn gate of claim 9 further comprising tensioning means, including a negator spring associated with the reel, for maintaining a relatively constant tension on the cord.

11. The turn gate of claim 9 wherein the finger is positioned on a receiving side of the base and includes a smoothly curving tip to guide the wire segments to the guide member in the entry gap and wherein the bracket is hingedly mounted to the base away from the finger, the bracket includes a notch for receiving the guide member and positioning the guide member in the entry gap, and the bracket extends vertically above the finger so that the entry gap is on the receiving side of the turn gate.

12. The turn gate of claim 9 wherein the bracket and base define an aperture for receiving the wire segments, the finger defining a support surface for the outer radius of the bend.

13. A method of positioning a precut and preconfigured wire segment of a wire harness between two connectors, wherein the wire segment has two ends and is one wire in a bundle having a bend defining an inner radius and an outer radius, the method comprising the steps of:

(a) robotically inserting one end of the wire segment into a receptacle in a connector;

(b) robotically guiding the wire segment in a nonlinear path into the inner radius of the bend; and (c) robotically securing the other end of the wire segment in a second connector of the harness while the wire segment remains on the inner radius of the bend.

14. A turn gate for making bends in a wire harness comprising:

(a) a base;

(b) a reel carried within an aperture in the base;

(c) a spring connected between the reel and the base;

(d) a bracket affixed to the base and including a notched end;

(e) a finger, including a longitudinal slot and a smoothly curving tip, extending from the base toward the notched end of the bracket to define a side-opening mouth above the tip; and (f) a tensioned guide means affixed to and wound on the reel and affixed to the bracket across the mouth in the slot and notched for receiving wire segments presented to the mouth by a robot and for directing the wire segments serially to an inner radius of the bend of the harness.

* * * * *

UNITED STATES PATENT AND TRADEMARK OFFICE

CERTIFICATE OF CORRECTION

PATENT NO. : 4,704,775

DATED : November 10, 1987

INVENTOR(S) : Dan A. Cross

Figure 7:
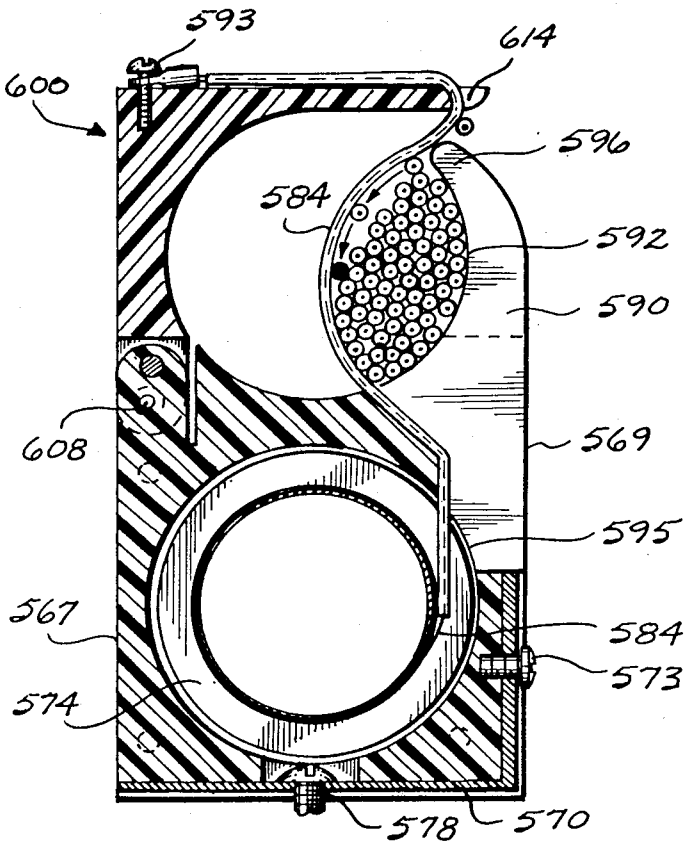
FIG. 7 is a side sectional view taken generally along line 7—7 of FIG. 6.

It is certified that error appears in the above-identified patent and that said Letters Patent is hereby corrected as shown below:

| | |
|---|---|
| Column 3, line 63: | "feed" should be --feet-- |
| Column 4, line 40: | "go" should be --to-- |
| Column 4, line 47: | "578" should be --577-- |
| Column 5, line 3: | "594" should be --590-- |
| Column 5, line 6: | "592" should be --590-- |
| Column 5, line 7: | "578" should be --584-- |
| Column 5, line 8: | "of" should be --or-- |
| Column 5, line 9: | "inthe" should be --in the-- |
| Column 5, line 42: | "594" should be --590-- |
| Column 5, line 49: | insert --by-- after "guided" |
| Column 5, line 51: | "594" should be --590-- |
| Column 6, line 8: | "inluding" should be --including-- |
| Column 6, line 26: | "2" should be --1-- |
| Column 6, line 46: | insert --to-- after "attached" |
| FIGURE 7: | "578" should be --577-- |

Signed and Sealed this

Fourth Day of October, 1988

*Attest:*

*Attesting Officer*

DONALD J. QUIGG

*Commissioner of Patents and Trademarks*